United States Patent [19]

Blankenship

[11] Patent Number: 4,495,873

[45] Date of Patent: Jan. 29, 1985

[54] INCINERATOR FOR BURNING ODOR FORMING MATERIALS

[75] Inventor: Ernest B. Blankenship, Dallas, Tex.

[73] Assignee: Research Products/Blankenship Corporation, Dallas, Tex.

[21] Appl. No.: 517,285

[22] Filed: Jul. 26, 1983

[51] Int. Cl.[3] ..... F23G 3/04

[52] U.S. Cl. ..... 110/250; 110/190; 110/192; 110/203; 110/208; 110/211; 110/214; 110/242; 110/248; 110/293

[58] Field of Search ..... 110/187, 190, 191, 194, 110/203, 235, 242, 248, 250, 293, 192, 208, 211, 214; 13/20

[56] References Cited

U.S. PATENT DOCUMENTS

| | | | |
|---|---|---|---|
| 2,549,517 | 4/1951 | Persons | 110/250 |
| 2,823,626 | 2/1958 | Raucher | 110/191 |
| 3,068,812 | 12/1962 | Hemeon | 110/190 |
| 3,467,035 | 9/1969 | Anderson et al. | 110/250 |
| 3,496,890 | 2/1970 | LaRue | 110/250 |
| 3,924,547 | 12/1975 | Werner | 110/250 |
| 4,319,556 | 3/1982 | Schwartz et al. | 110/203 |

*Primary Examiner*—Edward G. Favors
*Assistant Examiner*—Steven E. Warner
*Attorney, Agent, or Firm*—Wm. T. Wofford; James C. Fails; Arthur F. Zobal

[57] ABSTRACT

The incinerator is made up of an inner housing located within an outer housing and which have spaced apart walls forming an interior space therebetween. The inner and outer housings have aligned upper openings with insulated closure members. A central chamber extends from the upper opening of the inner housing to a lower position for receiving material to be burned. An upper chamber holding a heat activated odor reducing catalyst surrounds the upper portion of the central chamber. A gas collection chamber surrounds the upper chamber and an exhaust blower is provided for drawing gas from the central chamber to the interior space by way of the heat activated odor reducing catalyst and the collection chamber. A heater is provided for preheating the heat activated odor reducing catalyst. A second exhaust blower is provided for drawing gas from the interior space to the atmosphere. A main heater is located within the lower portion of the central chamber for burning the material deposited therein. An air inlet extends through the wall of the inner housing to the central chamber and a blower is provided for drawing air from the interior space into the central chamber. Air ducts extend into the interior space for providing air to support combustion and for cooling purposes.

15 Claims, 3 Drawing Figures

INCINERATOR FOR BURNING ODOR FORMING MATERIALS

BACKGROUND OF THE INVENTION

1. Field of the Invention

The present invention relates to an incinerator for burning odor forming materials such as surgical waste, bandages, flesh, etc.

2. Summary of the Invention

The incinerator apparatus comprises an inner housing located within an outer housing with walls of the inner and outer housings being spaced apart forming an interior space therebetween. The inner and outer housings have aligned upper openings with insulated closure members. A central chamber extends from the upper opening of the inner housing to a lower position for receiving material to be burned. An upper chamber holding a heat activated odor reducing catalyst surrounds the upper portion of the central chamber. A gas collection chamber surrounds the upper chamber and exhaust means is provided for drawing gas from the central chamber to the interior space by way of the heat activated odor reducing catalyst and the collection chamber. A preheater is provided for preheating the heat activated odor reducing catalyst. A second exhaust means is provided for drawing gas from the interior space to the atmosphere. A main heater is located within the lower portion of the central chamber for burning the material deposited therein. An air inlet extends through the wall of the inner housing to the central chamber and a blower is provided for drawing air from the interior space into the central chamber. Air duct means extends from the exterior to the interior space for providing fresh air to support combustion and for cooling purposes.

In a further aspect, an upper surrounding wall extends between said upper and lower closure means and spaced apart apertures are formed through said upper surrounding wall for the flow of air therethrough.

In another aspect, control means is provided for sequentially turning on said preheater and then said main heater. The preheater remains on until a predetermined temperature is reached. Said control means turns said first and second exhaust means on and said blower means on when said main heater is turned on. In addition, said control means maintains said main heater on for a predetermined time period after which it turns said first and second exhaust means and said blower means off when a predetermined lower temperature is reached.

DESCRIPTION OF THE PREFERRED EMBODIMENT

Figure 1:
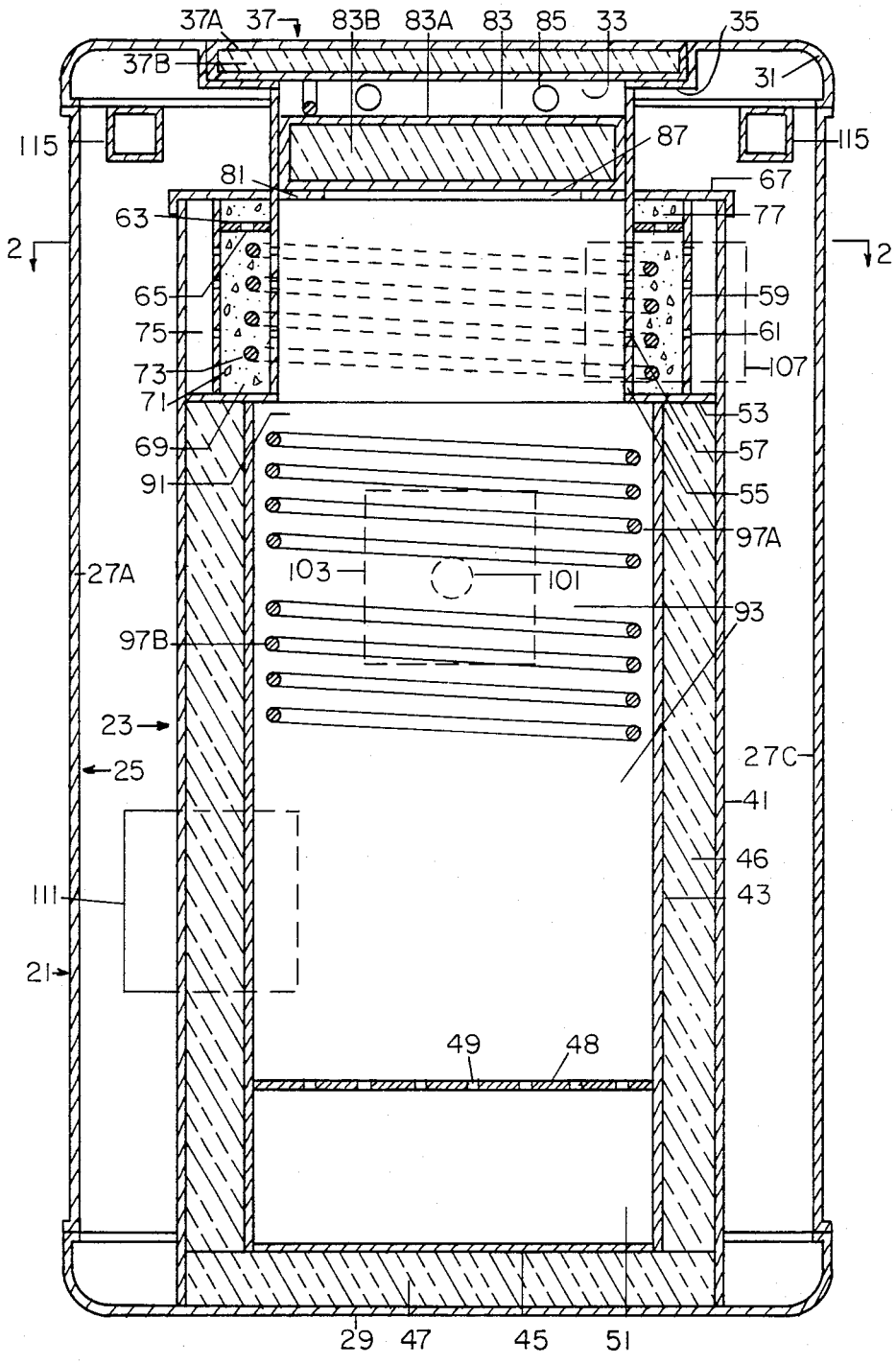
FIG. 1 is a cross sectional view of the incinerator apparatus of the present invention.
Figure 2:
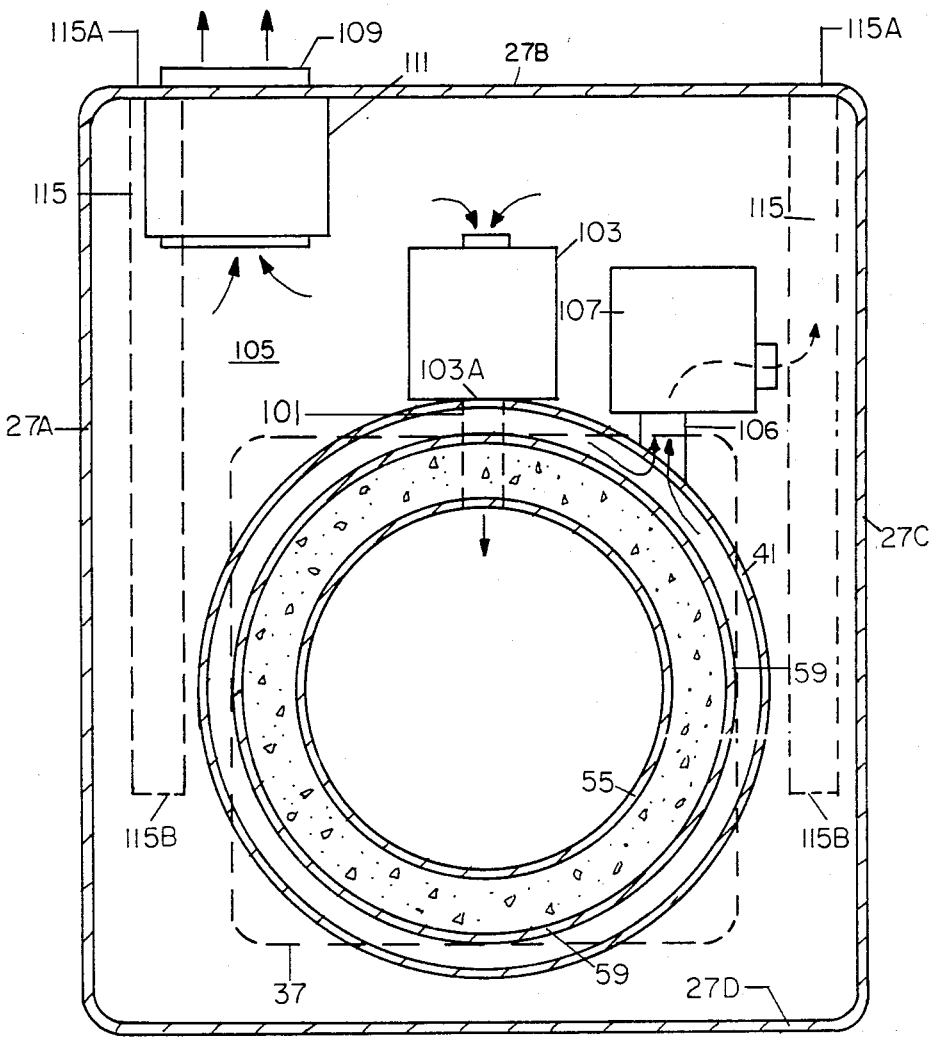
FIG. 2 is a cross section of FIG. 1 taken through the lines 2—2 thereof. The lower grate is not shown in FIG. 2.

Referring now to FIGS. 1 and 2 of the drawings, the incinerator apparatus of the present invention is identified at 21. It comprises an inner housing 23 located in an outer housing 25. The outer housing 25 comprises metal side walls 27A, 27B, 27C, and 27D having a metal bottom member 29 and a metal top member 31 removably secured to the lower and upper end thereof, for example, by key and slot connections. The top member 31 has an upper opening 33 with a recess 35 formed around the opening 33 for receiving a heat insulated lid 37 which is secured by hinges (not shown) to the top member 31. The lid 37 is formed by metal walls 37A surrounding heat insulating material 37B. The lid 37 may be raised or lowered to open or close the opening 33.

The inner housing 23 is formed by a cylindrical metal wall 41 having its bottom end secured to the bottom member 29 at a position such that the wall 41 is spaced from the side walls 27A, 27B, 27C, and 27D of the outer housing. Spaced inward from the cylindrical wall 41 is a smaller inner cylindrical metal wall 43 having a metal bottom 45 attached to its lower end. The spaced between walls 41 and 43 is filled with a heat insulating material 46. In addition, the space between walls 45 and 29 is filled with a heat insulating material 47. A metal grate 48 having openings 49 formed therethrough is secured within the wall member 43 above the bottom 45 such that the space 51 between the grate 48 and wall 45 form an ash pan.

A flat annular metal member 53 is secured to the top of the wall 43 and to the inside of wall 41. A metal cylindrical member 55 is secured to the inside edge of member 53 and extends upward to the recess 35. The lower portion of member 55 has perforations 57 formed therethrough. A cylindrical metal wall 59 is located between walls 55 and 41 and is secured to member 53. Member 59 has perforations 61 formed therethrough. A flat annular wall 63 having perforations 65 formed therethrough is secured between walls 55 and 59. A flat annular wall 67 is removably supported by the top edges of walls 59 and 41. An annular chamber 69 is formed between walls 53, 55, 59, and 63 for holding an odor reducing heat activated catalyst 71 such as aluminum oxide in pellet form. Also located within the chamber 69 are the coils 73 of an electrical preheater for preheating the catalyst 71. An annular gas collection chamber 75 is formed between walls 53, 59, 41, and 67. An annular catalyst reservoir chamber 77 is formed between walls 55, 59, 63, and 67 for holding an additional supply of fresh catalyst. As the catalyst in chamber 69 settles and is disintegrated, the chamber 69 is supplied with fresh catalyst from chamber 77 by way of perforations 65.

A flat annular wall 81 is secured to the inside of wall 55 for supporting a removable plug 83. Plug 83 is formed of metal walls 83A surrounding a heat insulating material 83B. Formed through the annular wall 55 above the plug 83 are apertures 85 for the passage of air. The purpose of the plug 83 is to close the upper opening 87 of the central chamber 91 formed by wall members 55, 53, and 43.

Located within the central chamber below the reservoir 69 are main electrical heater coils 97A and 97B. The portion of the central chamber 91 below the catalyst reservoir 69 which is defined at 93 forms a combustion chamber. The combustion chamber 93 has an inlet 101 formed through the side walls 41 and 43 of the inner housing 23 to which the outlet 103A of a blower 103 is connected. When the blower 103 is operated, it forces air from the interior space 105 between the inner and outer chambers, into the combustion chamber 93. The gas collection chamber 75 has an outlet 106 which is connected to the inlet of an exhaust blower 107. When the exhaust blower 107 is operated, it draws gas from the central chamber 91 into the interior space 105 by way of the perforations 57, the odor reducing heat activated catalyst 71, the perforations 61, and the gas collection chamber 75. The rear wall 27B of the outer housing has an outlet 109 formed therethrough to which the outlet of a second exhaust blower 111 is connected. When the exhaust blower 111 is operated, it draws gas from the interior 105 to the atmosphere by way of the outlet 109.

Two air ducts 115 have inlet ends 115A extending through the wall 27B of the outer housing. The ducts 115 extend inward and have outlet ends 115B located on opposite sides of the inner housing 23 near the front wall 27D of the outer housing.

In operation, the material to be burned or incinerated is deposited within the combustion chamber 93 by opening the lid 37 and removing the plug 83. The plug 83 then is inserted back in place and the lid 37 closed. The electric preheater 73 is actuated to preheat the catalyst. The heater coils 73 then are turned off and the heater coils 97A and 97B are energized for a predetermined time to burn the material deposited within the combustion chamber. When the coils 97A and 97B are energized, the blowers 103, 107, and 111 are operated. The blower 103 blows air into the combustion chamber to support combustion. The exhaust blower 107 causes the gas in the combustion chamber to flow through the catalyst 71 in the catalyst chamber 69 to remove the odor and then into the interior space 105 from which it is exhausted to the atmosphere by the way of the blower 111. Fresh air flows into the interior space 105 by way of the air ducts 115.

It has been found that in order to have proper mixing between the oxygen and combustion gases for burning of the waste material, it is necessary to have a blower 103 to force the air into the combustion chamber 93 and to have the inlet 101 at a certain size relative to the inside diameter of the combustion chamber 93. In one embodiment, the inside diameter of the combustion chamber 93 is 10 inches and the outlet 101 does not exceed 1 inch which is 1/10 of the effective diameter of the combustion chamber.

In order to prevent gases from passing through the crevices of the structure forming the combustion chamber without passing through the heat activated catalyst, it has been found that it is necessary to operate the combustion chamber 93 at a lower pressure than the interior space 105 which in turn is at a lower pressure than atmospheric pressure. The blowers 103, 107, and 111 are constructed and operated to achieve the desired pressures such that the volume capacity of blower 107 is greater than that of blower 103 and the volume capacity of blower 111 is greater than that of blower 107.

The incinerator apparatus is intended for use indoors. In order to prevent the exterior surfaces of the incinerator from reaching too high temperature, it is necessary to have the walls of the inner housing 23 spaced from the walls of the outer housing 25 and to bring the fresh air into the interior space 105 at a position such that it sweeps through a large portion of the interior space 105 to cool the metal surfaces.

Figure 3:
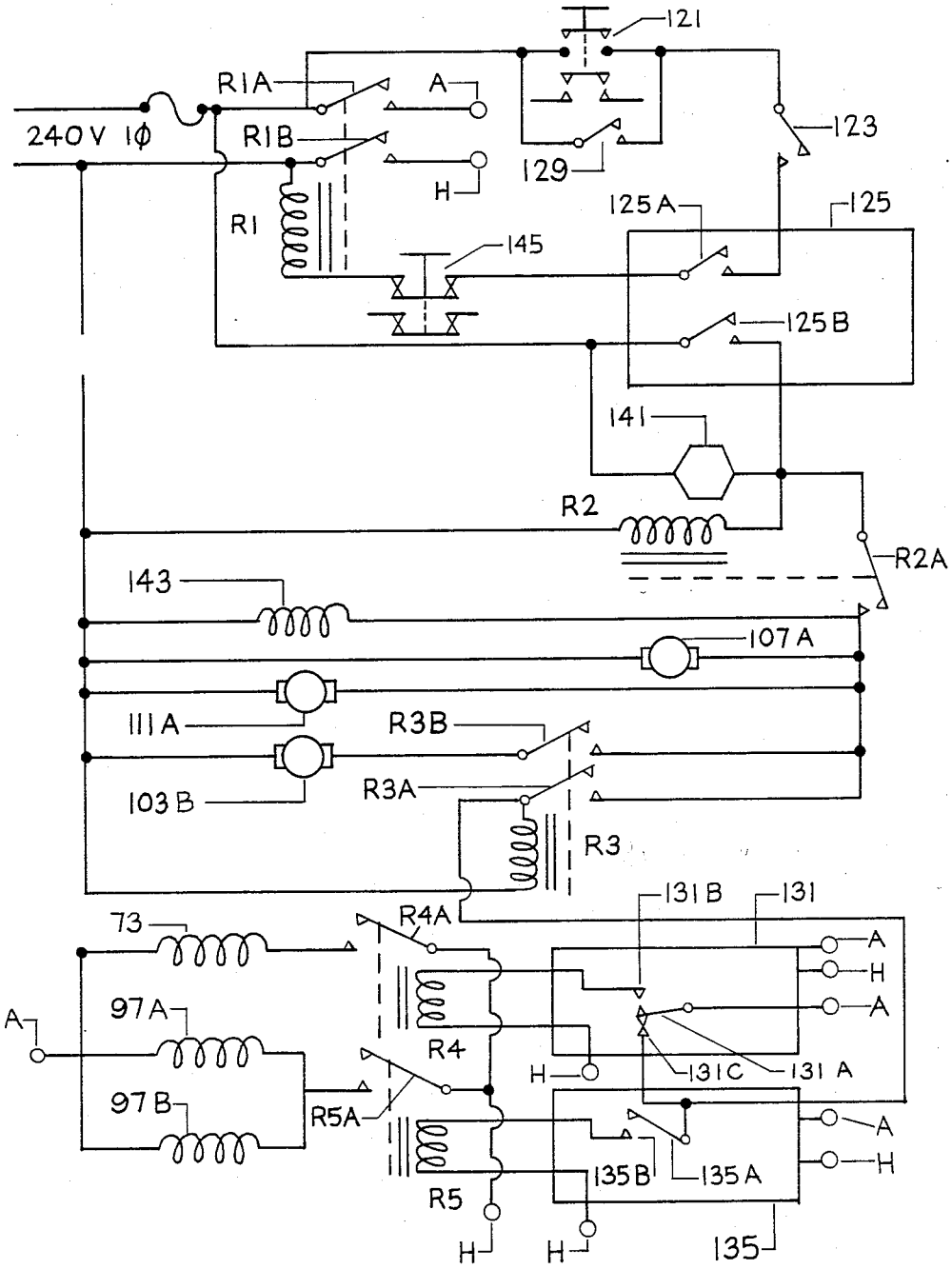
FIG. 3 is an electrical schematic of the control system for operating the incinerator apparatus.

Referring now to FIG. 3, reference numeral 121 identifies a start switch. A cover switch 123 is provided which is closed by the lid 37 when the lid 37 is moved to its closed position. Reference numeral 125 identifies a timer having internal switches 125A and 125B. When the start switch 121 is depressed and the cover switch 123 is closed, an internal relay of the timer 125 closes closing switches 125A and 125B. The timer 125 begins counting to 125 minutes. The start time contacts 125A and 125B then are isolated so that subsequent depression of the start switch 121 will not reset the timer to zero once the timing cycle has begun. When switch 125A closes, a main power relay R1 is energized closing switches R1A and R1B providing power to all points identified as A and H. When switch 125B closes, a relay R2 is energized closing switch R2A. The motors 103B, 107A, and 111A of the blowers then are turned on. The exhaust blower 111 provides positive air pressure against a sail switch 129 which closes this switch and sustains power relay R1 in its closed position.

A temperature controller 131 is activated when voltage is applied to points A and H. Its internal relay is activated and relay R4 is energized closing contact R4A providing power for the catalyst heater coil 73. Relay controller 131 is in effect a "one shot." It is set when power is applied and its inernal relay is closed causing switch 131A to engage contact 131B unitl its sensing elements detect 800° F. Once this temperature is detected, its internal relay releases and switch 131A engages contact 131C. The temperature controller 131 then isolates itself and does not cycle. When switch 131A engages contact 131C, power then is applied to temperature controller 135. The internal relay in temperature controller 135 is closed due to A-H power and its sensing element looks for 1500° F. When the internal relay of temperature controller 135 is closed, its switch 135A engages contact 135B. Voltage then is applied to relay R5 closing switch R5A causing coils 97A and 97B to be energized. When switch 131A engages contact 131C, relay R3 also is energized closing switches R3A and R3B. Relay R3 is latched through its own switches R3A and R3B and remains running independent of temperature controller 135. Temperature controller 135 cycles, maintaining the internal chamber temperature of 1500° F. When temperature controller 135 cycles, it energizes and releases relay R5.

When a preset time of 125 minutes is reached, the timer 125 releases and its internal relay opens allowing switches 125A and 125B to open thereby allowing relay R1 to drop from the circuit. This removes power from all of the A and H points. Relay R2 remains closed due to a special bimetallic thermostat or electronic sensing device 141 which detects a temperature greater than 100° F. As long as relay R2 remains closed, the exhaust blowers 107 and 111 and intake blower 103 remain running and a door lock solenoid 143 remains activated through the cool down cycle. The door lock solenoid 143 is employed to maintain the lid 73 in a closed position. Upon reaching a temperature of 100° F., the bimetallic thermostat 141 removes power from relay R2 which disengages the door lock solenoid and turns off the exhaust and intake blowers.

An emergency disconnect switch 145 is provided to disable the timer 125. When switch 145 is depressed, it resets the timer to zero and deactivates the timer. It also disconnects the main power relay R1. If the temperature is above 100° F., the bimetallic thermostat 141 will hold relay R2 closed, keeping the access door locked and the blowers running until the temperature is under 100° F.

I claim:

1. An incinerator apparatus, comprising:

an inner housing located within an outer housing, said outer housing having an upper opening adapted to be closed with an insulated outer housing closure means, said inner housing having an upper opening adapted to be closed with an insulated inner housing closure means, said inner housing having its side wall spaced from the side wall of said outer housing, said inner housing defining a central chamber extending from its upper opening to a lower position for receiving material to be burned, the upper portion of said central chamber having an inner perforated wall, a second perforated wall surrounding said inner perforated wall defining a surrounding chamber for holding an odor reducing heat activated catalyst, a surrounding wall spaced from and surrounding said second perforated wall defining a surrounding gas collection chamber, first exhaust means in fluid communication with said collection chamber for exhausting gas from said central chamber by way of said heat activated catalyst and said collection chamber to the interior space of said outer housing between said inner housing and said outer housing, second exhaust means in fluid communication with the interior space of said outer housing for exhausting gas therein to the atmosphere, first electrical heating means for preheating said odor reducing catalyst, the lower portion of said side wall of said inner housing comprising insulating material, second electrical heating means located in a combustion portion of said central chamber below said first electrical heating means for incinerating material deposited therein, air inlet means formed through the side wall of said inner housing, and blower means for forcing air within said interior space of said outer housing into said combustion portion of said chamber by way of said inlet means.

2. The incinerator apparatus of claim 1, wherein said blower means and said first and second exhaust means are located on one side of said inner housing relative to a predetermined side wall portion of said outer housing, fresh air duct means in fluid communication with the outside of said outer housing and extending from said side said wall portion of said outer housing through said interior space of said outer housing to a position near a side of said inner housing opposite said one side.

3. The incinerator apparatus of claim 1, wherein:

said outer housing closure means is spaced above said inner housing closure means, an upper surrounding wall extending between said outer housing closure means and said inner housing closure means, and spaced apart apertures formed through said upper surrounding wall for the flow of air therethrough.

4. The incinerator apparatus of claim 2, wherein:

said outer housing closure means is spaced above said inner housing closure means, an upper surrounding wall extending between said outer housing closure means and said inner housing closure means, and spaced apart apertures formed through said upper surrounding wall for the flow of air therethrough.

5. The incinerator apparatus of claim 1, comprising:

control means for sequentially turning on said first electrical heating means and then said second electrical heating means.

6. The incinerator apparatus of claim 5, wherein:

said control means turns said first electrical heating means off when it turns said second electrical heating means on.

7. The incinerator apparatus of claim 6, wherein:

said control means turns said first and second exhaust means on and said blower means on when said second electrical heating means is turned on, said control means maintains said second electrical heating means on for a predetermined time period after which it turns said first and second exhaust means and said blower means off when a predetermined lower temperature is reached.

8. The incinerator apparatus of claim 1, wherein:

said air inlet means is formed through said side wall of said inner housing below said inner perforated wall, said second perforated wall, and said surrounding gas collection chamber.

9. The incinerator apparatus of claim 1, wherein:

said first exhaust means comprises an exhaust blower means, said second exhaust means comprises an exhaust blower means.

10. The incinerator apparatus of claim 1, wherein:

said air inlet means is formed through the side wall of said inner housing below said inner perforated wall, said second perforated wall, and said surrounding gas collection chamber, said first exhaust means comprises an exhaust blower means, said second exhaust means comprises an exhaust blower means.

11. The incinerator apparatus of claim 1, wherein:

said first exhaust means, said second exhaust means, and said blower means are characterized such that when they are operating, said central chamber has a lower pressure than said interior space of said outer housing between said inner housing and said outer housing and said interior space of said outer housing between said inner housing and said outer housing has a lower pressure than atmospheric pressure.

12. The incinerator apparatus of claim 1, wherein:

said first exhaust means comprises an exhaust blower means, said second exhaust means comprises an exhaust blower means, said first exhaust blower means, said second exhaust blower means, and said blower means for forcing air within said interior space of said outer housing into said combustion portion of said chamber are characterized such that when said three blower means are operating, said central chamber has a lower pressure than said interior space of said outer housing between said inner housing and said outer housing and said interior space of said outer housing between said inner housing and said outer housing has a lower pressure than atmospheric pressure.

13. The incinerator apparatus of claim 12, wherein:

the volume capacity of said second exhaust blower means is greater than that of said first exhaust blower means and the volume capacity of said first exhaust blower means is greater than that of said blower means for forcing air within said interior space of said outer housing into said combustion portion of said chamber.

14. The incinerator apparatus of claim 13, wherein:

said air inlet means is formed through said side wall of said inner housing below said inner perforated wall, said second perforated wall, and said surrounding gas collection chamber.

15. The incinerator chamber of claim 14, wherein:

said outer housing closure means is spaced above said inner housing closure means, an upper surrounding wall extending between said outer housing closure means and said inner housing closure means, and spaced apart apertures formed through said upper surrounding wall for the flow of air therethrough.

* * * * *